US007555243B2

(12) United States Patent
Satoh et al.

(10) Patent No.: US 7,555,243 B2
(45) Date of Patent: Jun. 30, 2009

(54) CHARGING MEMBER, PROCESS CARTRIDGE INCLUDING THE SAME, AND IMAGE FORMING APPARATUS INCLUDING THE SAME

(75) Inventors: Masahiko Satoh, Tokyo (JP); Masanori Kawasumi, Kanagawa (JP); Yoshiyuki Kimura, Tokyo (JP); Eisaku Murakami, Tokyo (JP); Hideki Zemba, Kanagawa (JP); Takeshi Uchitani, Kanagawa (JP); Shin Kayahara, Kanagawa (JP); Shunichi Hashimoto, Kanagawa (JP); Eiji Shimojo, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 11/774,268

(22) Filed: Jul. 6, 2007

(65) Prior Publication Data

US 2008/0008499 A1 Jan. 10, 2008

(30) Foreign Application Priority Data

Jul. 6, 2006 (JP) ..... 2006-186764

(51) Int. Cl.
*G03G 15/02* (2006.01)

(52) U.S. Cl. ..... 399/168; 399/111; 399/115; 399/176

(58) Field of Classification Search ..... 399/107, 399/111, 115, 176
See application file for complete search history.

(56) References Cited

U.S. PATENT DOCUMENTS 5,146,280 A 9/1992 Kisu
5,659,853 A * 8/1997 Matsuda et al. ..... 399/176
5,790,927 A * 8/1998 Ando et al. ..... 399/176

(Continued)

FOREIGN PATENT DOCUMENTS

JP 03-240076 10/1991

(Continued)

OTHER PUBLICATIONS

U.S. Appl. No. 12/049,838, filed Mar. 17, 2008, Senoh et al.

*Primary Examiner*—Hoan H Tran
(74) *Attorney, Agent, or Firm*—Oblon, Spivak, McClelland, Maier & Neustadt, P.C.

(57) ABSTRACT

A charging member, which can be provided in a process cartridge and/or in an image forming apparatus, includes a conductive supporting member, an electrical resistance control layer formed on an outer circumferential surface of the conductive supporting member, and a nonconductive gap retaining member configured to retain a gap between the conductive supporting member and an image carrying member closely disposed to each other to have a constant distance. At least a portion of the nonconductive gap retaining member is mounted on the electrical resistance control layer at both ends of the conductive supporting member, and a circumference of the nonconductive gap retaining member projects from the electrical resistance control layer. An amount of projection of the gap retaining member from the electrical resistance control layer decreases as the gap retaining member tapers in a direction toward a center of an image formation region.

20 Claims, 4 Drawing Sheets

U.S. PATENT DOCUMENTS

| | | | | |
|---|---|---|---|---|
| 6,546,219 | B2 | 4/2003 | Sato et al. | |
| 6,807,390 | B2 | 10/2004 | Suda et al. | |
| 6,882,813 | B2 * | 4/2005 | Lee | 399/126 |
| 6,977,022 | B2 | 12/2005 | Sato et al. | |
| 7,151,904 | B2 | 12/2006 | Narita et al. | |
| 2005/0271420 | A1 | 12/2005 | Arai et al. | |
| 2006/0032581 | A1 | 2/2006 | Sato et al. | |
| 2008/0008499 | A1 | 1/2008 | Satoh et al. | |

FOREIGN PATENT DOCUMENTS

| | | |
|---|---|---|
| JP | 04-358175 | 12/1992 |
| JP | 2001-296723 | 10/2001 |
| JP | 2004-354477 | 12/2004 |
| JP | 2005-091818 | 4/2005 |

* cited by examiner

CHARGING MEMBER, PROCESS CARTRIDGE INCLUDING THE SAME, AND IMAGE FORMING APPARATUS INCLUDING THE SAME

CROSS REFERENCE TO RELATED APPLICATIONS

The present application claims priority to Japanese patent application no. 2006-186764, filed in the Japan Patent Office on Jul. 6, 2006, the disclosure of which is incorporated by reference herein in its entirety.

BACKGROUND OF THE INVENTION

1. Field of the Invention

The present invention relates to a charging member, a process cartridge including the charging member, and an image forming apparatus including the charging member. More particularly, the present invention relates to a charging member that is disposed opposite to an image carrying member in a close but non-contact manner for forming an image with an electrophotographic image forming method, a process cartridge including such charging member, and an image forming apparatus including such charging member. Such an image forming apparatus corresponds to a copier, laser beam printer, facsimile machine, and so forth that uses an electrophotographic image forming method.

2. Discussion of the Related Art

Related art electrophotographic image forming systems such as copiers, laser beam printers, facsimile machines, and so forth generally include a conductive member, for example, a charging member for charging an image carrying member or a photoconductor, and/or a transfer member for transferring a toner image formed on an image carrying member.

A well known technique for charging an image carrying member with a charging roller as a charging member includes a non-contact charging method to keep a desired performance ability of the charging roller as it ages.

In the above-described technique, a charging roller and a photoconductor serving as an image carrying member are disposed opposite to each other. The closest distance or gap between the charging member and the photoconductor is in a range from approximately 50 μm to approximately 200 μm. With the above-described configuration, a given amount of voltage is applied to the charging roller so as to charge the photoconductor.

With the non-contact charging method, the charging member and the photoconductor are not held in contact with each other. Therefore, various problems arising from using a contact charging method can be prevented. Specifically, adhesion of material of a charging roller to a photoconductor, permanent deformation of a photoconductor caused while stopping for a long period of time, and so on may not be caused.

In addition, another problem such as deterioration in charging ability due to adhesion of toner on a photoconductor to a charging roller may be reduced more with the non-contact charging method because less toner may adhere to the charging roller.

However, even with the above-described advantages, it is difficult to use the non-contact charging method in an electrophotographic image forming apparatus due to the following reasons:

1. Formation of a uniform gap between a charging member and a photoconductor is difficult; and 2. Gap variation between a charging member and a photoconductor may cause charging nonuniformity.

For the difficulty in forming a uniform gap of closest distance between a charging member and a photoconductor, a charging member may need to charge a photoconductor opposite to a given close gap therebetween so as to not produce a defective image due to the charging nonuniformity. To avoid producing such a defective image, the deviation in distance between the charging member and the photoconductor needs to be, ideally, approximately 20 μm at the closest non-contact part.

In a related art image forming apparatus including the above-described technique, spacer rings that serve as a gap retaining member are disposed at both ends of the charging roller so that the gap formed between the charging roller and the photoconductor can be constantly retained.

However, the above-described technique has not shown a detailed method of precisely setting the gap. In addition, the deviation of dimensional accuracy of the charging roller and the spacer rings can vary the distance of the gap.

A related art image forming apparatus employing a different well known technique includes a charging roller having an elastic rubber material and a gap retaining member in a form of a tape having a given thickness. This structure has eliminated the above-described disadvantages. However, the size of the elastic rubber material included for the charging member can easily vary with time due to aging, and therefore, the charging roller and the photoconductor cannot form a constant gap for a long period of time of use. In addition, the above-described structure has caused different disadvantages, for example, abrasion of the tape-type gap retaining member, toner falling and sticking between the charging roller and the tape-type gap retaining member. Due to these disadvantages, the gap between the charging member and the photoconductor cannot be maintained.

To eliminate these disadvantages, another technique has been provided to include gap retaining members mounted at both ends of a charging roller, as shown in FIG. 1.

In FIG. 1, a related art charging roller 10 includes a conductive supporting member 1, an electrical resistance control layer 2, and gap retaining members 3. Specifically, the gap retaining members 3 are mounted at both ends in a longitudinal direction of the electrical resistance control layer 2 of the charging roller 10. The gap retaining members 3 are held in contact with the electrical resistance controller layer 2 on both end surfaces in a longitudinal direction of the electrical resistance controller layer 2 and the conductive supporting member 1 at both ends in a longitudinal direction of the conductive supporting member 1. With the structure as shown in FIG. 1, the performance ability and reliability of the gap retaining member for a long-time use has been enhanced when compared with the tape-type gap retaining member.

Further, in a related art image forming apparatus with a further different known technique, a gap retaining member and an electrical resistance control layer are processed with a removal process at a concurrently same time so as to precisely control the gap formed therebetween. However, when the gap retaining member and the electrical resistance control layer are formed by different materials, their respective coefficients of water absorption may be different. Thus, when the environment around the related art image forming apparatus changes, the gap retaining member and the electrical resistance control layer may change in size by different amounts which may result in a change of the amount of the gap.

In addition, a gap retaining member and an electrical resistance control layer are formed with different materials having different toner sticking tendencies. The electrical resistance control layer in the above-described well-known technique includes an ion conductive layer as a resistance control agent that has a high water absorption rate. Therefore, under an environment with high temperature and high humidity, such an electrical resistance control layer absorbs humidity so that the electrical resistance control layer may swell or expand to change its size.

It is preferable that a gap retaining member is nonconductive and includes olefin material to reduce or prevent (if possible) toner sticking. With the above-described material, the gap retaining member can have a lower water absorption compared with the material of the electrical resistance control layer, and may cause a smaller size change in an environment with high temperature and high humidity. Therefore, a gap precisely formed may vary due to the environmental changes.

The gap retaining member is engaged with the charging roller by covering and capping the end portion of the charging roller. The preferable gap between the gap retaining member and the surface of the photoconductor is relatively small, e.g., in a range from approximately 20 μm to approximately 100 μm. Therefore, the gap retaining member may generally be thin, which cannot provide a volume that can maintain a rigidity thereof. In such case, a reinforcement part can be provided at an end portion of the charging member to easily reinforce the rigidity. However, if an inner portion of the electrical resistance control layer of the charging roller swells or expands as described above with time due to the process of aging, the abutting part with respect to the surface of the photoconductor may change or move up while the size of the reinforcement part does not change, which results in a disadvantage of changing the distance of the gap.

SUMMARY OF THE INVENTION

Exemplary aspects of the present invention have been made in view of the above-described circumstances.

Exemplary aspects of the present invention provide a charging member that can provide a gap having a constant distance with respect to an image carrying member.

Other exemplary aspects of the present invention provide a process cartridge that can include the above-described charging member.

Other exemplary aspects of the present invention provide an image forming apparatus that can include the above-described charging member.

In one exemplary embodiment, a charging member includes a conductive supporting member, an electrical resistance control layer formed on an outer circumferential surface of the conductive supporting member, and a nonconductive gap retaining member configured to retain a gap between the conductive supporting member and an image carrying member closely disposed to each other to have a constant distance. At least a portion of the charging member is mounted on the electrical resistance control layer at both ends of the conductive supporting member, and a circumference of the charging member projects from the electrical resistance control layer. With such a configuration, an amount of projection of the gap retaining member from the electrical resistance control layer decreases as the gap retaining member tapers in a direction toward a center of an image formation region.

A portion of the projection of the gap retaining member may overlap a portion of the electrical resistance control layer.

A maximum projecting part of the gap retaining member may be located outside the electrical resistance control layer in a longitudinal direction.

Further, in one exemplary embodiment, a process cartridge includes an image carrying member, and a charging member closely disposed to the image carrying member and configured to charge a surface of the image carrying member. The charging member includes a conductive supporting member, an electrical resistance control layer formed on an outer circumferential surface of the conductive supporting member, and a nonconductive gap retaining member configured to retain a gap between the conductive supporting member and an image carrying member closely disposed to each other to have a constant distance. At least a portion of the charging member is mounted on the electrical resistance control layer at both ends of the conductive supporting member, and a circumference of the charging member projects from the electrical resistance control layer. With such a configuration, an amount of projection of the gap retaining member from the electrical resistance control layer decreases as the gap retaining member tapers in a direction toward a center of an image formation region.

Further, in one exemplary embodiment, an image forming apparatus includes an image carrying member, and a charging member closely disposed to the image carrying member and configured to charge a surface of the image carrying member. The charging member includes a conductive supporting member, an electrical resistance control layer formed on an outer circumferential surface of the conductive supporting member, and a nonconductive gap retaining member configured to retain a gap between the conductive supporting member and an image carrying member closely disposed to each other to have a constant distance. At least a portion of the charging member is mounted on the electrical resistance control layer at both ends of the conductive supporting member, and a circumference of the charging member projects from the electrical resistance control layer. With such a configuration, an amount of projection of the gap retaining member from the electrical resistance control layer decreases as the gap retaining member tapers in a direction toward a center of an image formation region.

The image carrying member and the charging member may be integrally mounted to a process cartridge.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
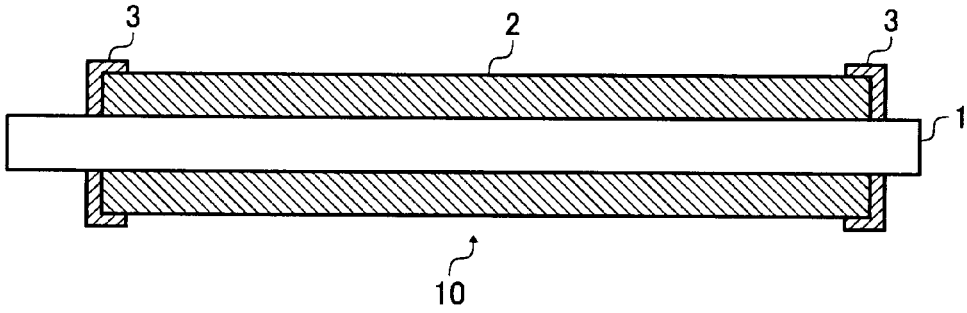
FIG. 1 BACKGROUND ART
FIG. 1 is a cross sectional view of a background art charging member.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
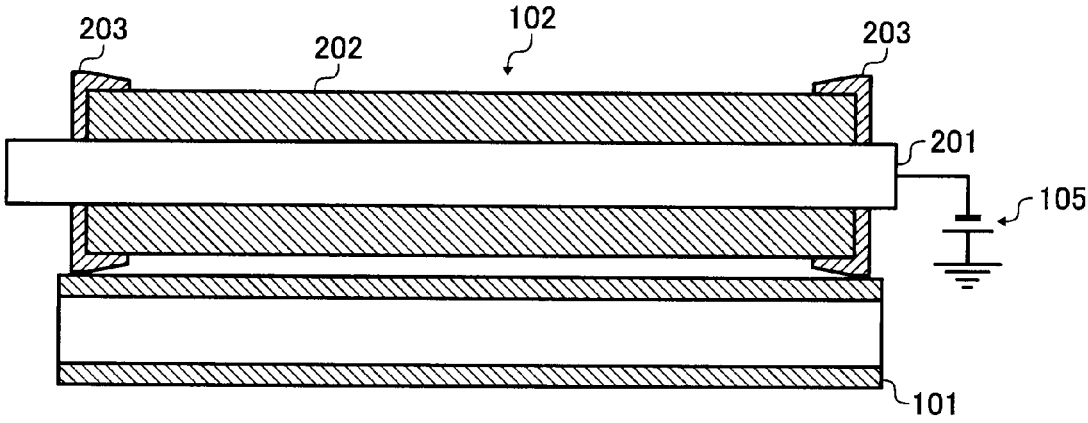
FIG. 2 is a cross sectional view of a conductive charging member according to an exemplary embodiment of the present invention.
Figure 3:
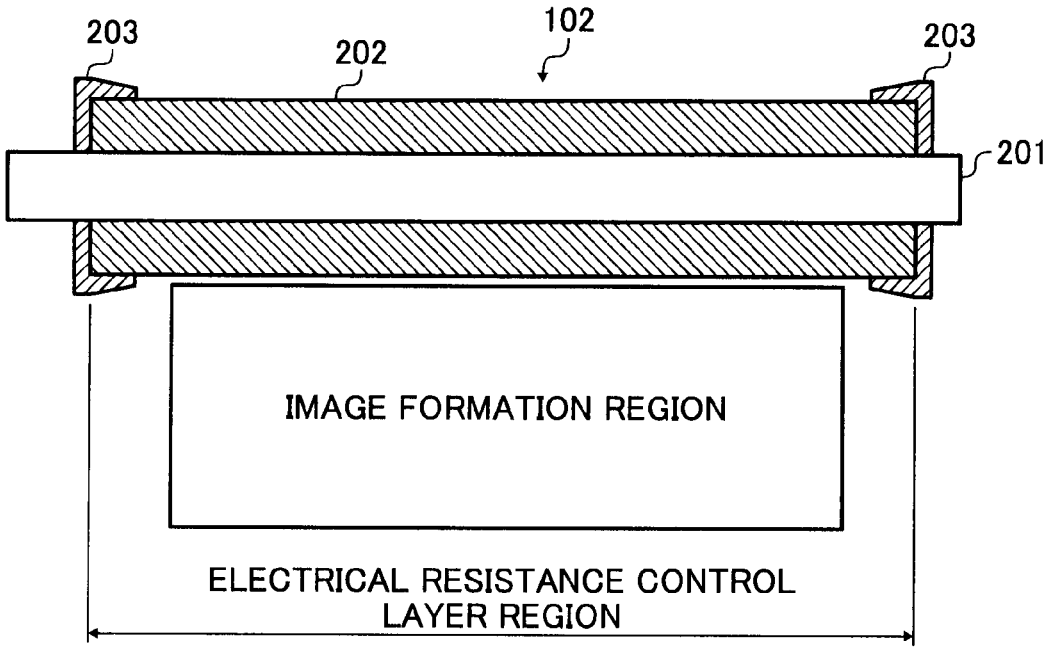
FIG. 3 is another cross sectional view of the conductive charging member of FIG. 2.

Referring to FIGS. 2 and 3, a cross section of a schematic structure of a conductive charging member used as a charging roller in an image forming apparatus according to an exemplary embodiment of the present invention is described.

In FIGS. 2 and 3, a charging roller 102 is a non-contact charging member, and includes a conductive supporting member 201, an electrical resistance control layer 202, and a gap retaining member 203.

The conductive supporting member 201 is formed in a cylindrical shape extending in a longitudinal direction thereof. At one end of the conductive supporting member 201, a power pack 105 that serves as a voltage applying power source may be connected so as to apply a predetermined voltage to the charging roller 102.

The electrical resistance control layer 202 is arranged around an outer circumferential surface of the conductive supporting member 201 and is formed in a hollow circular cylindrical shape, extending in a longitudinal direction thereof.

The gap retaining member 203 is formed in a cylindrical shape having a hole at the center thereof. The respective gap retaining members 203 may be mounted on the outer circumferential surfaces at both ends of the electrical resistance control layer 202.

The charging roller 102 serves as a conductive charging member according to an exemplary embodiment of the present invention. However, it should be understood that the shape of the charging member is not limited as such and can be of any shape which can be used to achieve the charging functions. Specifically, the charging member according to the present invention can be of any shape if the gap retaining member 203 includes a material having a high sliding ability or if the gap retaining member 203 merely can be rotated with a photoconductor drum 101 (see also FIGS. 8 and 9) that serves as an image carrying member.

The charging roller 102 is disposed opposite to the photoconductor drum 101 while being pressed toward the photoconductor drum 101. A gap retaining member 203 is mounted at both ends of the charging roller 102 and held in contact with the photoconductive drum 101. The charging roller 102 employs a non-contact charging method to charge the photoconductive drum 101 without contacting the photoconductor drum 101.

Specifically, an outer diameter of the electrical resistance control layer 202 is made slightly smaller than an outer diameter of the gap retaining member 203. With such structure, a gap may be formed between an outer surface of the electrical resistance control layer 202 and an outer surface of the photoconductor drum 101.

Further, the charging roller 102 is disposed so that the gap retaining member 203 can be held in contact with an outside of an image formation region or charging region of the photoconductor drum 101, which is a non-image formation region thereof. With the above-described structure, the charging roller 102 may be applied with a predetermined voltage to charge the image formation region of the photoconductor drum 101.

The charging roller 102 and the photoconductor drum 101 rotate while facing each other. By rotating as such, stress caused by the operating current on the same surface of the charging roller 102 or the photoconductor drum 101 may be sequentially diffused, and the life of the charging roller 102 and the photoconductor drum 101 can be extended.

Further, the photoconductor drum 101 and the charging roller 102 are not limited to be formed in a cylindrical shape. Alternatively, the photoconductor drum 101 and the charging roller 102 can be formed in an elliptical cylinder shape. Specifically, the preferable shape is based on the assumption that a gap between an outer circumferential surface of the photoconductor drum 101 and the electrical resistance control layer 202 of the charging roller 102 is constantly the same. Under such a condition, the shape is formed, for example, so that an amount of projection of the gap retaining member 203 projecting from the electrical resistance control layer 202 of the charging roller 102 is substantially constant.

The charging roller 102 that employs a non-contact charging method may need to maintain the distance of the gap at a predetermined interval and to be uniformly provided.

When the gap becomes greater, a condition of applying a voltage to the charging roller 102 needs to be higher. This can easily cause an electrical degradation and/or abnormal electrical discharge with respect to the photoconductor drum 101. Therefore, it is preferable that the gap is equal to or smaller than 100 μm.

Figure 4:
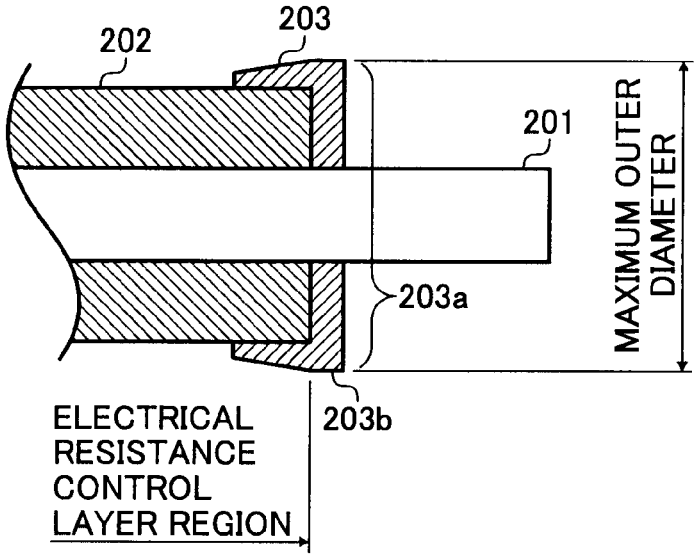
FIG. 4 is a schematic structure of the conductive charging member with a gap retaining member of a tapered shape.

Referring to FIG. 4, a detailed structure of the gap retaining member 203 according to an exemplary embodiment of the present invention is described.

As shown in FIG. 4, the gap retaining member 203 is engaged with the charging roller 102 by overlapping or capping both ends of the charging roller 102 from outside of the charging roller 102. The gap retaining member 203 includes a reinforcement part 203*a* and a contact part 203*b*. The reinforcement part 203*a* has a discoid shape to reinforce the charging roller 102 at both ends thereof. The contact part 203*b* has a ring shape arranged around the side surface or circumferential surface of the reinforcement part 203*a*. The gap retaining member 203 is held in contact at the contact part 203*b* thereof with the photoconductor drum 101.

In the above-described structure, the reinforcement part 203*a* and the contact part 203*b* do not need to have an identical width size. Specifically, even if the width or distance of the circumferential surface of the reinforcement part 203*a* in the longitudinal or axial direction of the charging roller 102 is smaller than the width or distance of the circumferential surface of the contact part 203*b* in the longitudinal or axial direction of the charging roller 102, the functional purpose of the reinforcement part 203*a* can be achieved. That is, the gap retaining member 203 can enhance the rigidity or strength of the charging roller 102. Further, when the electrical resistance control layer 202 expands with time due to aging, the gap retaining member 203 may not be easily affected.

The gap retaining member 203 may have a structure with an outer diameter gradually decreasing its size or becoming smaller in a direction from the end of the charging roller 102 toward a center of the image formation region or charging region.

Figure 5:
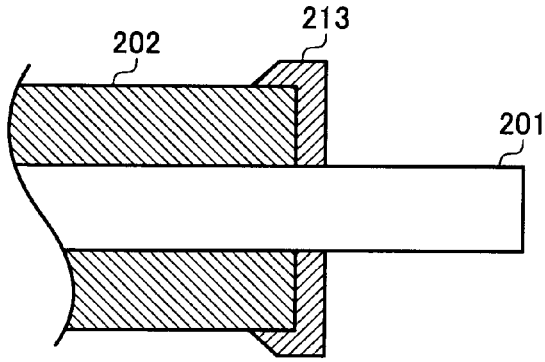
FIG. 5 is a schematic structure of the conductive charging member with a gap retaining member of a chamfer shape.
Figure 6:
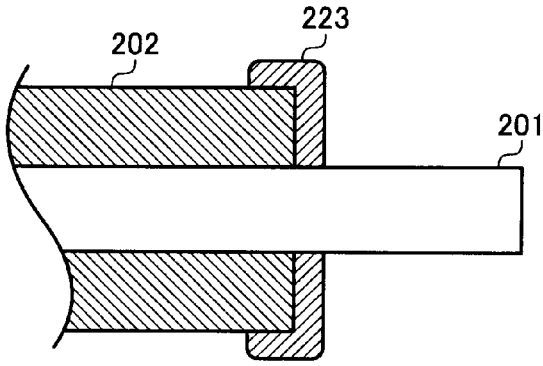
FIG. 6 is a schematic structure of the conductive charging member with a gap retaining member of a round shape.

To gradually decrease the outer diameter of the gap retaining member 203, the shape of the gap retaining member 203 may be formed in various shapes. For example, the present invention can be applied to the gap retaining member 203 of a tapered shape as shown in FIG. 4, a gap retaining member 213 of a chamfer shape as shown in FIG. 5, or a gap retaining member 223 of a round shape as shown in FIG. 6. However, it should be understood that the shape of a gap retaining member is not limited as such and can be of any shape which can be used to achieve the gap retaining functions.

The start position to change the size of the outer diameter is arbitrarily decidable. It is, however, preferable that the size of the outer diameter is changed within an effective region of the electrical resistance control layer 202. By so doing, it is greatly effective to stably retain a gap from a large expansion with age of the electrical resistance control layer 202.

Figure 7:
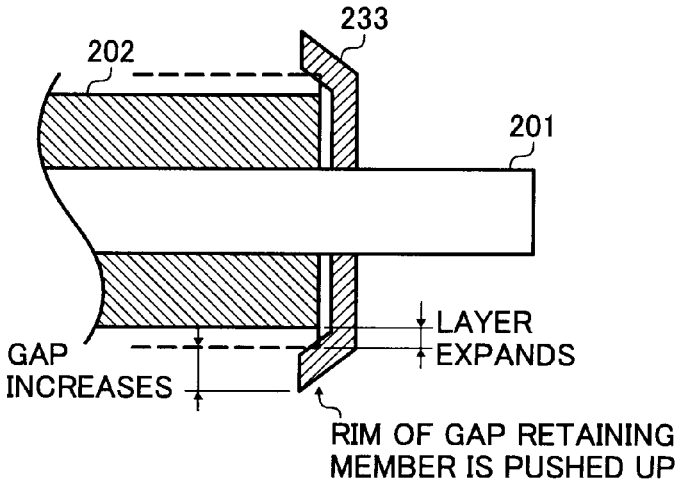
FIG. 7 is a cross sectional view of the conductive charging member with an expanded electrical resistance control layer.

For example, when the electrical resistance control layer 202 expands to increase the size of the outer diameter thereof, the portion of a gap retaining member 233 overlapping with the electrical resistance control layer 202 may be pushed up, as shown in FIG. 7. Since the gap retaining member 233 of FIG. 7 is not formed in a tapered, chamfered or round shape, that is, a shape without any technique of decreasing the outer diameter in the direction toward the center of the image formation region, the rim of the gap retaining member 233 is pushed up so that the outer diameter thereof increases. However, the increased amount of the outer diameter can be controllably reduced by tapering the gap retaining member 203 (or the gap retaining members 213 or 223), so as to reduce the contact amount of the gap retaining member 203 with respect to the photoconductor drum 101.

Figure 8:
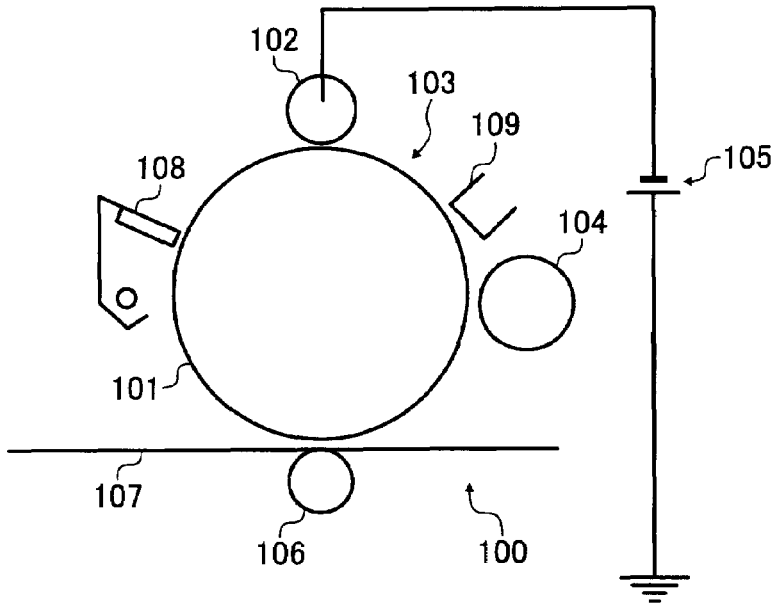
FIG. 8 is a schematic configuration of an image forming apparatus according to an exemplary embodiment of the present invention.

Referring to FIG. 8, a schematic configuration of an electrophotographic image forming apparatus 100 according to an exemplary embodiment of the present invention is described.

In FIG. 8, the image forming apparatus 100 includes a photoconductive drum 101, a charging roller 102, a light beam 103, a developing roller 104, a voltage applying power source 105, a transfer roller 106, a cleaning unit 108, and a surface potential electrometer 109.

The photoconductor drum 101 serves as an image carrying member and forms an electrostatic latent image on a surface thereof.

The charging roller 102 is disposed facing the photoconductor drum 101 in a contact or non-contact manner and charges the surface of the photoconductor drum 101.

The light beam 103 corresponds to a laser light beam emitted by a writing unit (not shown) or a light reflected from an original document.

The developing roller 104 supplies toner onto the electrostatic latent image formed on the surface of the photoconductor drum 101 to develop the electrostatic latent image to a visible toner image.

The voltage applying power source 105 applies a predetermined voltage to the charging member 102.

The transfer roller 106 transfers the visible toner image formed on the surface of the photoconductor drum 101 onto a recording medium 107 that is fed from a sheet feeding part (not shown).

The cleaning unit 108 removes residual toner remaining on the photoconductor drum 101 after the transfer operation.

The surface potential electrometer 109 measures the surface potential of the photoconductor drum 101.

Figure 9:
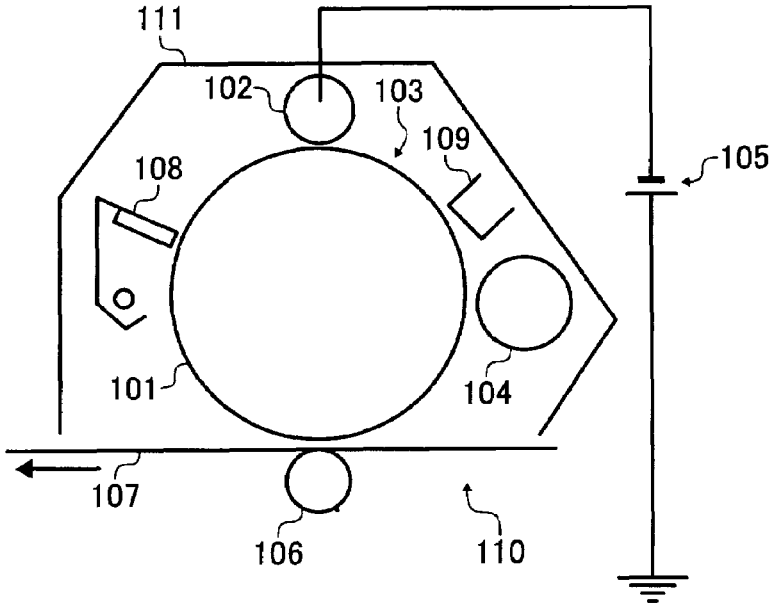
FIG. 9 is a schematic configuration of an image forming apparatus according to an exemplary embodiment of the present invention with a process cartridge according to an exemplary embodiment of the present invention.

Referring to FIG. 9, a schematic configuration of a different electrophotographic image forming apparatus 110 according to an exemplary embodiment of the present invention is described.

The configuration and functions of the image forming apparatus 110 of FIG. 9 are basically identical to these of the image forming apparatus 100 of FIG. 8. Except, in the image forming apparatus 110 of FIG. 9, the photoconductor drum 101, the charging roller 102, the developing roller 104, the cleaning unit 108, and the surface potential electrometer 109 are integrally mounted in a process cartridge 111.

However, the image forming apparatuses 100 and 110 can achieve the image forming operations and functions in a same manner.

Such operations performed by each of the image forming apparatuses 100 and 110 are described below.

The charging roller 102 uniformly charges the surface of the photoconductor drum 101 to a desired potential level.

The writing unit emits a light beam 103 to irradiate the surface of the photoconductor drum 101 so as to form an electrostatic latent image corresponding to a desired image on the surface of the photoconductor drum 101.

The developing roller 104 develops the electrostatic latent image formed on the surface of the photoconductor drum 101 to a visible toner image.

The transfer roller 106 transfers the visible toner image on the photoconductor drum 101 onto the recording medium 107.

The cleaning unit 108 removes residual toner remaining on the surface of the photoconductor drum 101.

The recording medium 107 having the toner image on a surface thereof is conveyed to a fixing unit (not shown) so that the fixing unit can apply heat and pressure to fix the toner image onto the recording medium 107.

By repeating the above-described image forming operations, a desired image may be formed on each recording medium 107.

As described above, the charging roller 102, according to an exemplary embodiment of the present invention, includes the gap retaining member 203 that is disposed around the outer circumferential surface of the conductive supporting member 201 and in the vicinity of both ends of the conductive supporting member 201. The gap retaining member 203 is arranged to decrease its amount of projection from the electrical resistance control layer 202 in a direction toward the center of the image formation region or charging region. Thereby, even after the charging roller 102 changes in size with age, a constant distance of the gap can be retained.

In addition, the gap retaining member 203 is controlled such that the amount of projection of the gap retaining member 203 decreases in the effective region of the electrical resistance control layer 202. It is in the effective region of the electrical resistance control layer 202 that the size of the charging roller 102 mostly changes with age. Thus, without the gap retaining member 203 described herein, it may be difficult to counteract an adverse affect due to the change of the charging roller 102 in size with age to the charging roller 102.

Further, the maximum projecting part of, or the greatest outer diameter of, the gap retaining member 203 is located outside the electrical resistance control layer 202 where the least change in size of the charging roller 102 is caused. Thereby, the gap between the charging roller 102 and the photoconductor drum 101 can be retained with a constant distance, from the initial time period and after a given time has elapsed.

Further, if the charging roller 102 is incorporated into the process cartridge 111, an easily replaceable process cartridge 111 can be provided. By providing such a process cartridge 111 to an electrophotographic image forming apparatus, a high quality image can be produced and stably maintained for a long period of time.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. A charging member, comprising:

a conductive supporting member;

an electrical resistance control layer formed on an outer circumferential surface of the conductive supporting member; and a nonconductive gap retaining member configured to retain a gap between the conductive supporting member and an image carrying member closely disposed to each other to have a constant distance, at least a portion of which being mounted on the electrical resistance control layer at both ends of the conductive supporting member, and a circumference of which projecting from the electrical resistance control layer, wherein an amount of projection of the gap retaining member from the electrical resistance control layer decreases as the gap retaining member tapers in a direction toward a center of an image formation region.

2. The charging member according to claim 1, wherein a portion of the projection of the gap retaining member overlaps a portion of the electrical resistance control layer.

3. The charging member according to claim 1, wherein a maximum projecting part of the gap retaining member is located outside the electrical resistance control layer in a longitudinal direction.

4. The charging member according to claim 1, wherein the gap between the conductive supporting member and the image carrying member is equal to or less than 100 μm.

5. The charging member according to claim 1, wherein, as the charging member expands, the gap retaining member is configured to keep the gap between the conductive supporting member and the image carrying member at the constant distance.

6. The charging member according to claim 1, wherein the gap retaining member has a tapered, chamfered, or round shape.

7. A process cartridge, comprising:

an image carrying member; and a charging member closely disposed to the image carrying member and configured to charge a surface of the image carrying member, the charging member including a conductive supporting member;

an electrical resistance control layer formed on an outer circumferential surface of the conductive supporting member; and a nonconductive gap retaining member configured to retain a gap between the conductive supporting member and the image carrying member to have a constant distance, at least a portion of which being mounted on the electrical resistance control layer at both ends of the conductive supporting member, and a circumference of which projecting from the electrical resistance control layer, wherein an amount of projection of the gap retaining member from the electrical resistance control layer decreases as the gap retaining member tapers in a direction toward a center of an image formation region.

8. The process cartridge according to claim 7, wherein a portion of the projection of the gap retaining member of the charging member overlaps a portion of the electrical resistance control layer.

9. The process cartridge according to claim 7, wherein a maximum projecting part of the gap retaining member is located outside the electrical resistance control layer in a longitudinal direction.

10. The process cartridge according to claim 7, wherein the gap between the conductive supporting member and the image carrying member is equal to or less than 100 μm.

11. The process cartridge according to claim 7, wherein, as the charging member expands, the gap retaining member is configured to keep the gap between the conductive supporting member and the image carrying member at the constant distance.

12. The process cartridge according to claim 7, wherein the gap retaining member has a tapered, chamfered, or round shape.

13. An image forming apparatus, comprising:

an image carrying member; and a charging member closely disposed to the image carrying member and configured to charge a surface of the image carrying member, the charging member including a conductive supporting member;

an electrical resistance control layer formed on an outer circumferential surface of the conductive supporting member; and a nonconductive gap retaining member configured to retain a gap between the conductive supporting member and the image carrying member to have a constant distance, at least a portion of which being mounted on the electrical resistance control layer at both ends of the conductive supporting member, and a circumference of which projecting from the electrical resistance control layer, wherein an amount of projection of the gap retaining member from the electrical resistance control layer decreases as the gap retaining member tapers in a direction toward a center of an image formation region.

14. The image forming apparatus according to claim 13, wherein a portion of the projection of the gap retaining member overlaps a portion of the electrical resistance control layer.

15. The image forming apparatus according to claim 14, wherein the image carrying member and the charging member are integrally mounted to a process cartridge.

16. The image forming apparatus according to claim 13, wherein a maximum projecting part of the gap retaining member is located outside the electrical resistance control layer in a longitudinal direction.

17. The image forming apparatus according to claim 16, wherein the image carrying member and the charging member are integrally mounted to a process cartridge.

18. The image forming apparatus according to claim 13, wherein the gap between the conductive supporting member and the image carrying member is equal to or less than 100 μm.

19. The image forming apparatus according to claim 13, wherein, as the charging member expands, the gap retaining member is configured to keep the gap between the conductive supporting member and the image carrying member at the constant distance.

20. The image forming apparatus according to claim 13, wherein the gap retaining member has a tapered, chamfered, or round shape.

* * * * *